United States Patent [19]

Okiura et al.

[11] 4,403,941

[45] Sep. 13, 1983

[54] COMBUSTION PROCESS FOR REDUCING NITROGEN OXIDES

[75] Inventors: Kunio Okiura; Iwao Akiyama; Hiroshi Terada; Yoshijiro Arikawa; Akira Baba; Shigeki Morita, all of Kure, Japan

[73] Assignee: Babcock-Hitachi, Ltd., Tokyo, Japan

[21] Appl. No.: 175,823

[22] Filed: Aug. 5, 1980

[30] Foreign Application Priority Data

Aug. 6, 1979 [JP] Japan ..... 54-99487

[51] Int. Cl.[3] ..... F23N 1/02

[52] U.S. Cl. ..... 431/10; 431/12; 431/165; 431/174; 431/351; 110/347

[58] Field of Search ..... 431/2, 10, 12, 159, 431/165, 174, 177, 178, 179, 351; 110/347

[56] References Cited

U.S. PATENT DOCUMENTS

| | | | |
|---|---|---|---|
| 3,727,562 | 4/1973 | Bauer | 431/10 X |
| 3,890,084 | 6/1975 | Voorheis et al. | 431/10 |
| 3,948,223 | 4/1976 | Benson | 431/10 X |
| 4,050,877 | 9/1977 | Craig et al. | 431/10 X |
| 4,095,928 | 6/1978 | Jones et al. | 431/8 |
| 4,117,075 | 9/1978 | Sano | 431/8 X |
| 4,240,784 | 12/1980 | Dauvergne | 431/351 |
| 4,250,820 | 2/1981 | Lautenschläger | 110/347 |

FOREIGN PATENT DOCUMENTS

| | | | |
|---|---|---|---|
| 52-70434 | 6/1977 | Japan | 431/10 |
| 54-105328 | 8/1979 | Japan | 431/10 |

*Primary Examiner*—Samuel Scott
*Assistant Examiner*—Margaret A. Focarino
*Attorney, Agent, or Firm*—Thomas E. Beall, Jr.

[57] ABSTRACT

A combustion process for reducing nitrogen oxides in combustors is proposed wherein combustion takes place successively forming an incomplete combustion zone, a reducing combustion zone, and a complete combustion zone, respectively corresponding to primary burners, secondary burners and air ports or after-burners, successively arranged in the direction of gas stream in a furnace. According to the present invention, it is possible to reduce nitrogen oxides by improving a manner of combustion without providing any denitrating apparatuses for exhaust gas.

12 Claims, 10 Drawing Figures

COMBUSTION PROCESS FOR REDUCING NITROGEN OXIDES

BACKGROUND OF THE INVENTION

1. Field of the Invention

This invention relates to a combustion process for reducing the amount of nitrogen oxides generated in combustors, and more particularly it relates to an improvement in multi-stage combustion processes.

2. Description of the Prior Art

Various nitrogen oxides such as NO, $NO_2$, $N_2O_3$, etc., referred to hereinafter as $NO_x$, have been exhausted from combustors employing fossil fuels, and they have been becoming a portion of atmospheric pollution substances.

$NO_x$ reducing processes employed so far are roughly classified into the following five processes:

processes for reducing so-called thermal $NO_x$ by lowering combustion temperature through (1) mixing of exhaust gas, (2) multi-stage combustion or (3) flame division; (4) processes for reducing so-called fuel $NO_x$ through fuel conversion; and (5) processes for reducing $NO_x$ into harmless $N_2$ by means of catalysts, hydrocarbons, ammonia, etc.

Among these processes, those of (1), (2) and (3) by lowering combustion temperature have a drawback that exhaust gas contains a large amount of dusts consisting mainly of unburnt carbon. Processes of (4) for removing fuel $NO_x$ raise problems such as increase in fuel cost. Further, reduction processes of (5) require a reducing agent-injecting apparatus, formation of catalyst layer, etc., resulting inevitably in making an apparatus of a larger scale and more complicated.

SUMMARY OF THE INVENTION

An object of the present invention is to provide a multi-stage combustion process for overcoming the above-mentioned drawbacks of the prior art and minimizing the amount of $NO_x$ generated in the combustor during combustion.

Another object of the present invention is to provide a combustion process for reducing the amount of $NO_x$ contained in exhaust gas by improving combustion manner without providing any denitration apparatus.

Still another object of the present invention is to provide a combustion process according to which the amounts of unburnt carbon and other dusts contained in exhaust gas are small and the combustion state is stabilized.

Further objects of the present invention will be apparent from the description mentioned below.

The present invention resides in:

a combustion process for combustors which comprises arranging at least one primary burner, at least one secondary burner and at least one air port or after-burner, successively in this order in the direction of gas stream in the hollow body of a combustor provided with a space for combustion and an exit for combustion exhaust gas; and burning fuels in a ratio of air to fuel less than 1 at said primary burner to form an incomplete combustion zone, burning fuels in a ratio of air to fuel lower than the abovementioned ratio at said secondary burner to form a reducing combustion zone, and burning fuels at said air port or at said after-burner where air is fed in excess amount required for a complete combustion of the fuels, to form a complete combustion zone, respectively, in the free space of the hollow body of the combustor.

PREFERRED EMBODIMENTS OF THE PRESENT INVENTION

In the present specification, the ratio of air to fuel, abbreviated hereinafter to A/F ratio, is defined as an equivalent ratio of air to fuel, which is equal to a ratio of actual quantity of air to theoretical quantity of air for combustion, that is so called excess air factor.

In the combustion process of the present invention, the A/F ratio at the primary burner is lower than 1, ordinarily in the range of 0.4 to 0.95, preferably from 0.6 to 0.95, where somewhat incomplete combustion occurs. If the A/F ratio at the primary burner is 1 or higher, reduction is not sufficiently carried out in the following combustion zone at the secondary burner, while if the ratio is too low, the load of the complete combustion at the later stage becomes higher, resulting in the increase of $NO_x$ or unburnt materials.

The A/F ratio at the secondary burner is lower than that at the primary burner, suitably in the range of 0.2 to 0.8, preferably in the range of 0.2 to 0.6 where incomplete (or reduction) combustion occurs, and it is preferably lower than 0.8 times the value of A/F ratio at the primary burner. If the A/F ratio at the secondary burner exceeds an A/F ratio of the primary burner, of 0.8, reduction of $NO_x$ may be insufficient.

The combustion gas from the secondary burner is then completely burnt by adding air through an air port or by adding air and fuel through an after-burner, which is provided at the upper part of the secondary burner. The amount of air fed to the air port or the after-burner is adjusted so that the final oxygen concentration in the exhaust gas amounts to be 0.1 to 5%.

As for air for combustion, besides fresh air, gases of a low oxygen concentration such as combustion exhaust gas from combustors may be employed in admixture with fresh air. It is effective in lowering $NO_x$ concentration in the exhaust gas to dilute the fresh air fed to after-burners with the combustion exhaust gas, or to supply fresh air (or the diluted fresh air) in stages through a plurality of air ports or after burners arranged in the direction of gas flow.

In the combustion apparatus according to the present invention, there may be arranged a combination of a primary burner with a secondary burner in a multi-stage (two stages or more) to thereby balance thermal flux generated by combustion. It is also possible to provide a flame stabilizer consisting of a number of heat transfer pipes above each primary burner or secondary burner to thereby stabilize flame. Further, it is also possible to combine the combustion apparatus or process of the present invention with heretofore known means or processes for reducing $NO_x$ concentration, to thereby obtain effective results.

Figure 1:
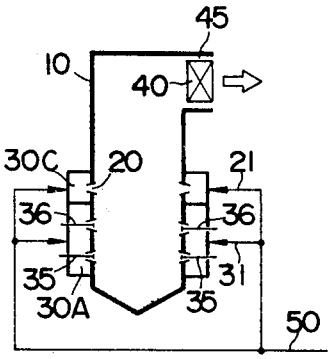
FIG. 1 shows a cross-sectional view of a boiler furnace to which the combustion process of the present invention is applied.
Figure 2:
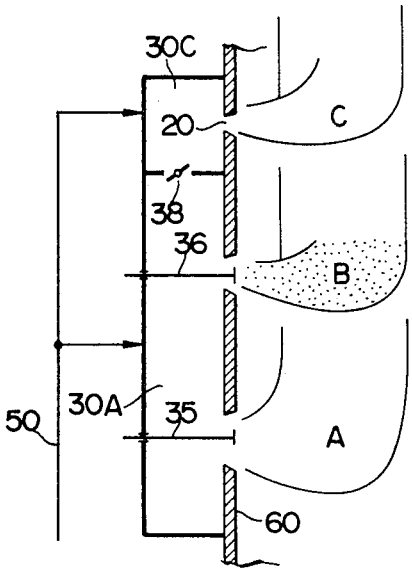
FIG. 2 shows an enlarged cross-sectional view of the burner parts on the sidewall of the boiler furnace of FIG. 1.

FIG. 1 shows a cross-sectional view of a boiler furnace illustrating a preferred embodiment of the present invention, and FIG. 2 shows a figure illustrating the details of the burner of the furnace of FIG. 1. With reference to FIG. 1, the boiler furnace comprises the hollow body of the furnace 10; the respective pairs of primary burner 35, secondary burner 36 and air port 20 successively provided upwards along the sidewall 60 of the body of the furnace; wind boxes 30A and 30C covering both the primary and secondary burners and the air ports, respectively; a main duct 50 for feeding air for combustion to the wind boxes; branched ducts from the main 21 and 31; an exhaust gas exit 45 provided at the top part of the body of the furnace; and a superheater 40 provided at the exhaust gas exit. In addition, a damper 38 (see FIG. 2) is provided between the wind boxes 30A and 30C, whereby the air amounts in the boxes between each other may be controlled. Fuel is fed to burners 35 and 36, while air is fed from ducts 50, 21 and 31 via wind boxes 30A and 30C to the burners 35 and 36 and air ports 20. In this case, the A/F ratio at burners 35 is brought into a range of ratio corresponding to somewhat incomplete combustion, e.g. 0.85 to 0.95; the A/F ratio at burners 36, into a range of ratio corresponding to reducing combustion, lower than the above ratio, e.g. 0.2 to 0.8; and the amount of air at air ports 20, into an amount sufficient for completely burning unburnt materials contained in the combustion gas from the burners 35 and 36. The amounts of air at the respective burners may be controlled by a means provided at the respective burners such as slide damper. Through combustion of the fuel in the furnace, combustion zones indicated by symbols A, B and C are formed in the vicinities of burners 35 and 36 and air ports 20. Since the A/F ratio in the zone A is in the range of e.g. 0.85 to 0.95, not only thermal $NO_x$ but also prompt $NO_x$ which appears only in the flame of excessive hydrocarbon fuels, are formed, the formation reactions of them are represented by the following equations:

$$O_2 \rightarrow 2.O \quad (1)$$

$$N_2 + .O \rightarrow .N + NO \quad (2)$$

$$.N + O_2 \rightarrow .O + NO \quad (3)$$

$$H_2O \rightarrow .H + .OH \quad (4)$$

$$.N + .OH \rightarrow .H + .NO \quad (5)$$

$$CH_4 \rightarrow .CH_3 + .H \quad (6)$$

$$N_2 + .CH_3 \rightarrow .NH_2 + HCN \quad (7)$$

$$.H + HCN \rightarrow .CN + H_2 \quad (8)$$

$$.CN + O_2 \rightarrow CO + NO \quad (9)$$

$$.NH_2 + O_2 \rightarrow H_2O + NO \quad (10)$$

In the above equations, those of (1) to (5) show formation of thermal $NO_x$ and those of (6) to (10) show formation of prompt $NO_x$.

The present inventors have made various studies on these formation and decomposition reactions, and as a result, have found that reduction of $NO_x$ with a reducing gas such as CO gas is hindered by $O_2$ so that the effect of reduction cannot be exhibited, whereas intermediate products represented by radicals formed in the combustion flame have an effective reducing performance. Based on these findings, according to the present invention, a reducing combustion zone B is further provided in addition to the combustion zone A where somewhat incomplete combustion occurs to thereby further promote the reduction of $NO_x$ with the intermediate products. Namely, in the reducing combustion zone B, the A/F ratio at secondary burners 36 is made as very low as 0.2 to 0.8 to thereby decompose $NO_x$ formed in the zone A with the intermediate products i.e. to subject it to gas phase reduction. The reaction temperature of said zone B may be in the range of 1000° C. to 2000° C., for example. Main reactions thereof are represented by the following equations:

as partial oxidation and thermal decomposition reactions, $$CH_4 \rightarrow .CH_3 + .H \quad (11)$$

$$N_2 + .CH_3 \rightarrow .NH_2 + HCN \quad (12)$$

$$.H + HCN \rightarrow .CN + H_2 \quad (13)$$

as gas phase reduction reactions, $$NO + .NH_2 \rightarrow N_2 + H_2O \quad (14)$$

$$NO + .CN \rightarrow N_2 + CO \quad (15)$$

$$NO + CO \rightarrow N_2 + O_2 \quad (16)$$

What is particularly noted is decomposition of NO by way of equations (14) and (15). As apparent from comparison of these equations (14) and (15) with the above-mentioned equations (9) and (10) as formation reactions of prompt $NO_x$, competition takes place between reactions of NO with radicals $.NH_2$ and .CN (equations (14), (15)) and reactions of $O_2$ with radicals $.NH_2$ and .CN (equations (9), (10)). However, as seen in the selective gas phase reduction of NO with ammonia ($NH_3$), formation of N—N bond is much easier in the presence of reducing intermediate combustion products, which the present invention based upon.

Next, in the combustion zone C, CO, $H_2$, HCN, $NH_3$, hydrocarbons, unburnt carbon, etc. formed by combustion in an amount of air less than the theoretical one are completely burnt by air fed through air ports 20, or by air and fuel fed through after burners, so as to give a final $O_2$ concentration in the exhaust gas of about 0.1 to 5%. In this zone, the lower the oxygen concentration and the reaction temperature, the lower the decomposition of $NH_3$ and HCN and the conversion to $NO_x$. In other words, as the oxygen concentration and the reaction temperature are lowered, the following equations (19) and (20) are predominant. On the other hand, the higher the oxygen concentration and the reaction temperature, the superior the equations (17) and (18) become.

$$HCN+5/4O_2 \rightarrow NO+CO+\tfrac{1}{2}H_2O \quad (17)$$

$$NH_3+5/4O_2 \rightarrow NO+3/2H_2O \quad (18)$$

$$HCN+\tfrac{3}{4}O_2 \rightarrow \tfrac{1}{2}N_2+CO+\tfrac{1}{2}H_2O \quad (19)$$

$$NH+\tfrac{3}{4}O_2 \rightarrow \tfrac{1}{2}N+3/2H_2O \quad (20)$$

Accordingly, it is desirable that air is supplied to after-burners dividedly in several steps or diluted with a gas having a lower concentration of $O_2$, such as a combustion exhaust gas, thus the $NO_x$ concentration in the exhaust gas is more reduced.

Figure 3:
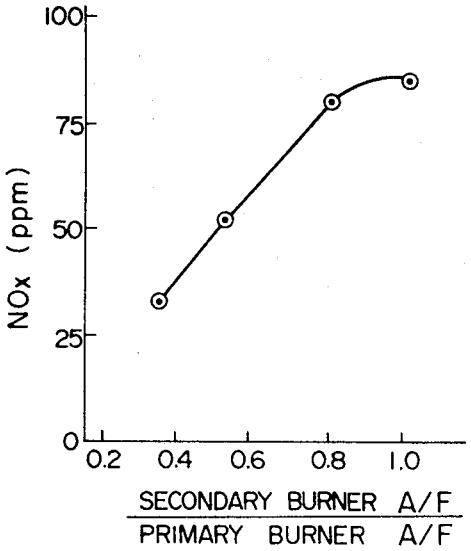
FIG. 3 shows a figure illustrating the relationship between the ratio of air to fuel ratio at secondary burners to that at primary burners and $NO_x$ concentration in exhaust gas, in the case where a combustion experiment was carried out with the boiler furnace of FIG. 1.

FIG. 3 shows the results of a combustion experiment carried out employing the combustion apparatus shown in FIGS. 1 and 2. A box type furnace of 2 m (width)×2 m (depth)×2 m (height) with a lining of fire resistant material is employed as a laboratory furnace, propane gas as a fuel was fed into the furnace in a total A/F ratio of 1.1. Air was fed through air ports 20 in a total A/F ratio of 0.4 and the remainder was fed through burners 35 and 36. Four burners were so arranged that two of them located on one side were opposed to other two located on the other side, and one of the two and one of the other two were employed as a secondary burner at the upper stage, respectively, while another of the two and another of the other two were employed as a primary burner at the lower stage, respectively. The same amounts of fuel were supplied to these four burners, respectively. Air was preheated to 300° C., mixed with the fuel, and subjected to combustion in diffusion manner. Fuel was burned in a quantity of 605 Kcal/hr. By varying the respective distribution proportions of air amount at the primary and secondary burners, the relationship between ratio of A/F ratios at the two burners and $NO_x$ concentration in exhaust gas was observed. It is seen from the results shown in FIG. 3 that as compared with a conventional two-stage combustion process where the ratio of A/F ratios at two burners is 1.0 or more, the amount of $NO_x$ formed is lowered in the case of the process of the present invention wherein the A/F ratio at the secondary burner is reduced lower than 1 and the ratio of A/F ratio at the two burners is reduced particularly down to 0.8 or lower.

Figure 4:
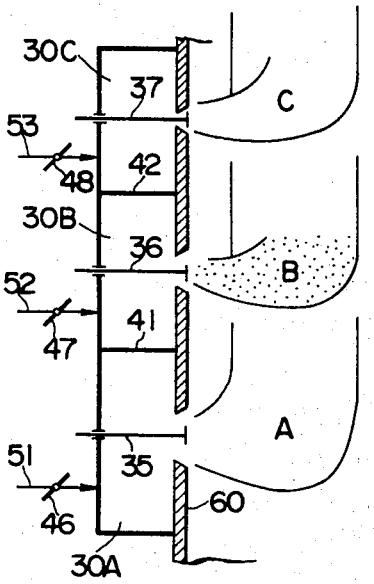
FIG. 4 shows an enlarged cross-sectional view of burner parts on the sidewall of a boiler furnace according to the present invention wherein after burners are employed.

FIG. 4 shows a cross-sectional view of burner part in a boiler furnace illustrating another embodiment of the present invention. In this furnace, primary burners 35, secondary burners 36 and after-burners 37 are provided in this order on the sidewall 60 of the furnace in the direction of gas stream, and the respective burners are covered by wind boxes 30A, 30B and 30C, respectively, to which boxes air-feeding lines 51, 52 and 53 equipped with dampers 46, 47 and 48, respectively, are connected. Numerals 41 and 42 each represent a partition wall. This apparatus is different from that of FIGS. 1 and 2 in that after-burners 37 are provided and the respective burners are independently provided with a wind box to thereby make possible the control of the respective amounts of air fed at these burners. In the case where after-burners are provided downstream of secondary burners as described above, combustion in an A/F ratio at primary burners 35, of 0.4 to 0.9, preferably about 0.6, in an A/F ratio at secondary burners 36, of 0.2 to 0.8, preferably about 0.4 and in an A/F ratio at after-burners 37, of 1 or higher, preferably about 1.3, brought about a great effectiveness upon $NO_x$ reduction. Further, as for the proportion of the respective amounts of fuel fed at these burners, a proportion of 60 to 70% of the total amount of fuel fed for primary burners 35, 25 to 35% thereof for secondary burners 36 and 1 to 10% thereof for after-burners 37 is a condition for obtaining a great effectiveness upon $NO_x$ reduction. According to the above-mentioned embodiment wherein after-burners 37 are provided in addition to primary burners 35 and secondary burners 36, no partial temperature depression in the reaction zone C takes place to thereby make it possible to carry out sufficient combustion of unburnt materials. Further, if the combustion at the after-burners is carried out by supplying air in a divided manner, or by supplying a diluted air with a combustion exhaust gas, the $NO_x$ formation in the combustion zone C will be more supressed as shown in the above equations (19) and (20). After-burners may be provided serially in the direction of gas stream.

Figure 5:
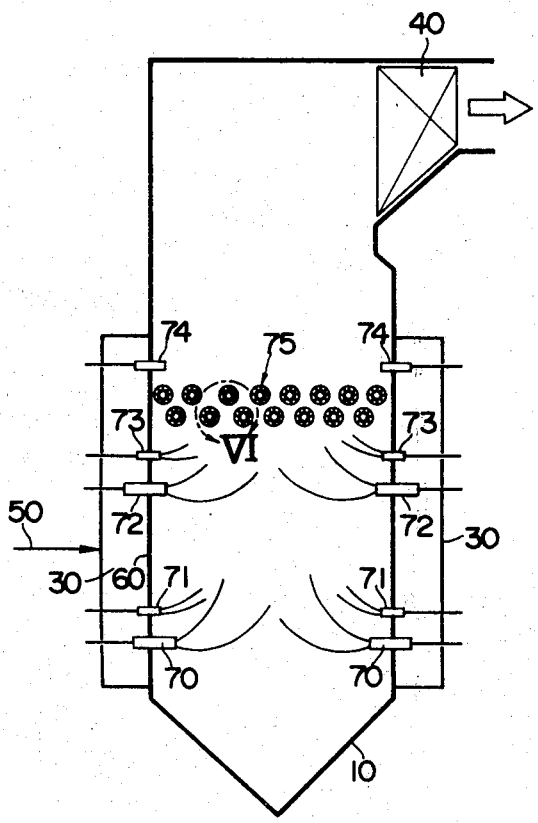
FIG. 5 shows a cross-sectional view of a boiler furnace wherein the respective primary burners and the respective secondary burners are arranged in two-stages and further after-burners and flame stabilizers are provided.
Figure 6:
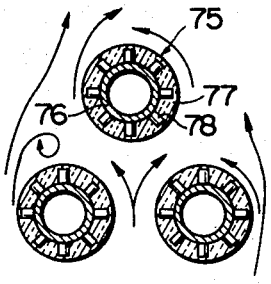
FIG. 6 shows a partly enlarged cross-sectional view of a flame stabilizers (VI) employed in the boiler furnace of FIG. 5.

FIG. 5 shows a cross-sectional view of a boiler furnace illustrating still another preferred embodiment of the present invention wherein a combination of primary burners with secondary burners and another combination thereof are arranged in two stages in the direction of gas stream, and further, flame stabilizers are provided in a combustion zone to regulate the level of combustion flame. In this figure, on the sidewall 60 of furnace 10 are provided first primary burners 70, first secondary burners 71, second primary burners 72 and second secondary burners 73 successively in the gas stream, and above the secondary burners 73 are provided after-burners 74. The capacity of these secondary burner is about 1/10 to 3/10 of that of the primary burner and the capacity of the after-burner is about 2/10 to 3/10 of that of the primary burner. Between secondary burners 73 and after-burners 74 are arranged a group of flame stabilizers 75 in zigzag configuration, which, as shown in FIG. 6, consist each of a combination of a pipe 76 of a highly corrosion-resistant material such as stainless steel with a thermal insulant 77 coating the outer peripheral wall of the pipe and are arranged in the cross section of furnace. In order to prevent burning loss of the pipes, water is passed through the inside of the pipes. In addition, studs 78 are provided on the pipes 76 in order to tightly fix the thermal insulant 77 thereto.

A definite amount of air is fed to the above-mentioned burners through an air-feeding line 50 and a wind box 30, and combustion is carried out at the respective primary burners 70 and 72 in a A/F ratio of about 0.8 to 0.9, i.e. in a somewhat excessive amount of fuel, whereby flames at primary burners 70 and 72 as well as the partial oxygen pressures in the respective vicinities thereof are reduced to thereby inhibit $NO_x$ formation. Further, at the respective secondary burners 71 and 73 arranged in the respective upper parts of the above-mentioned primary burners, combustion is carried out in a A/F ratio of about 0.6 to 0.8, whereby the reducing atmosphere formed by the combustion at primary burners 70 and 72 is further enhanced to reduce $NO_x$ into harmless $N_2$. On the other hand, the combustion gas contains unburnt carbon, hydrocarbons, etc. due to the reducing atmosphere, but when the gas is further passed through the flame stabilizers 75, a swirling motion is formed therein to increase the intensity of turbulent flow and from a stabilized flame. After the gas has been retained in the flame stabilizers for a while, it is completely burnt at after-burners 74 located thereabove. The A/F ratio at the after-burners 74 is in the range of about 2 to 2.5, for example. In the above-mentioned combustion, the total A/F ratio in the boiler is adjusted to about 1 to 1.05 and an adequate combustion is effected.

Figure 7A:
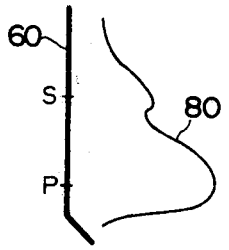
FIGS. 7A and 7B show schematical views of thermal fluxes at the time of combustion in the case where a combination of a primary burners with secondary burners is arranged in one stage (FIG. 7A) and in two stages (FIG. 7B), respectively, in a furnace.
Figure 7B:
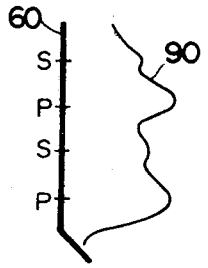

FIGS. 7A and 7B show schematical views of thermal fluxes 80 and 90 at the time of combustion in cases where a combination of primary burners with secondary burners are arranged in one stage and two stages in the furnace, respectively. In these figures, numeral 60 shows a furnace wall and P and S show locations where primary burners and secondary burners are provided, respectively. It is understood in view of these figures that in the case of a combination of primary burners with secondary burners arranged in one stage, the thermal flux has a high peak; hence formation of thermal $NO_x$ at primary burners can not fully be avoided, whereas in the case of a combination thereof arranged in two stages, the thermal flux is levelled and at the same time the diffusion of reducing substances formed at secondary burners is improved, whereby gas phase reduction of $NO_x$ is promoted.

Figure 8:
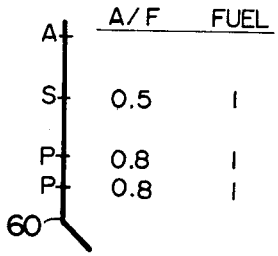
FIGS. 8 and 9 show schematical arrangements of a primary burner P, a secondary burner S and an air port A on the sidewall of a furnace, and air to fuel ratios and fuel ratios at these means.
Figure 9:
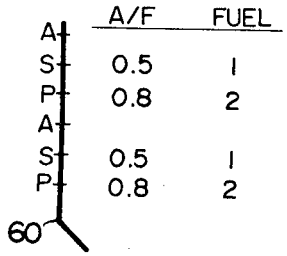

FIG. 8 and FIG. 9 show schematical arrangements of a primary burner P, a secondary burner S and an air port A on the sidewall of the furnace, and A/F ratios and fuel ratios at these means. In such arrangements, A/F ratio at a primary burner was made 0.8; A/F ratio at a secondary burner, 0.5; and a ratio of fuel amount at primary burner to that at secondary burner, 2:1, to observe $NO_x$ concentration in the exhaust gas. As a result, $NO_x$ concentration in the case of one stage arrangement of FIG. 8 was 18.0 ppm, whereas that in the case of two-stage arrangement of FIG. 9 was improved to 15.1 ppm.

According to the present invention wherein combustion takes place successively forming an incomplete combustion zone, a reducing combustion zone and a complete combustion zone, employing primary burner, secondary burner and air port or after-burner, successively arranged in the direction of gas stream in a furnace, it is possible to reduce $NO_x$ without providing any exhaust gas-denitrating apparatuses and yet it is possible to reduce $NO_x$ only by improving the manner of combustion, without adding any utilities such as $NH_3$-pouring means, for example, and further it is possible to readily carry out the present invention by merely adding an air port or after-burner to the existing facilities as boilers.

The above-mentioned embodiments have been described with reference to a boiler, but the present invention is not limited to a boiler, but broadly applied to gas turbines, general industrial furnaces, incinerators and other combustion furnaces.

It should be apparent that the above described embodiments are merely illustrative of but a few of the many possible embodiments which represent the applications of the principles of the present invention. Numerous and varied other arrangements can be readily devised by those skilled in the art without departing from the scope of the present invention. For example, it is possible to vary the numbers and locations of primary burner, secondary burner, air port, after-burner and flame stabilizer, the flow amounts and distributions of air and fuel, etc. within the scope of the present invention.

What is claimed is:

1. A combustion process for reducing nitrogen oxides in combustors which comprises arranging at least one primary burner, at least one secondary burner and at least one air port, successively in this order in the direction of gas stream in the hollow body of a combustor provided with a space for combustion and an exit for combustion exhaust gas; and burning fuels in a ratio of air to fuel less than 1 at said primary burner to form an incomplete combustion zone, burning fuels in a ratio of air to fuel lower than the above-mentioned ratio at said secondary burner to form a reducing combustion zone, and burning fuels at said air port where air is fed in excess amount required for a complete combustion of the fuels, to form a complete combustion zone, respectively, in the free space of the hollow body of the combustor.

2. A combustion process according to claim 1, wherein the air to fuel ratio at said secondary burner is 0.8 or lower.

3. A combustion process according to claim 1 or claim 2, wherein the air to fuel ratio at said primary burner is in the range of 0.6 to 0.95 and that at said secondary burner is in the range of 0.2 to 0.8.

4. A combustion process according to claim 1 or claim 2, wherein at least one after-burner is provided at said air port and said complete combustion is attained under fuel feed.

5. A combustion process according to claim 4, wherein air for supplying to said after-burner is diluted with a combustion exhaust gas.

6. A combustion process according to claim 4, wherein air is supplied in stages to said after-burner.

7. A combustion process according to claim 4, wherein the air to fuel ratio at said primary burner is in the range of 0.4 to 0.9, that at said secondary burner is in the range of 0.2 to 0.8 and that at said after-burner is 1 or higher.

8. A combustion process according to claim 4, wherein the proportion of the respective amounts of fuel fed at said primary burner, said secondary burner and said after-burner is 60 to 70% of the total amount of fuel fed for said primary burner, 25 to 35% thereof for said secondary burner and 1 to 10% thereof for said after-burner.

9. A combustion process according to claim 1 or claim 2, wherein a combination of said primary burner with said secondary burner is provided in at least two stages and said incomplete combustion zone and said reducing combustion zone are repeatedly formed in the direction of gas stream.

10. A combustion process according to claim 1 or claim 2, wherein at least one flame stabilizer is arranged in the vicinity of said primary or secondary burner.

11. A combustion process according to claim 1, wherein the air to fuel ratio at said secondary burner is 0.8 times the air to fuel ratio at the primary burner.

12. A combustion process according to claim 7, wherein the air to fuel ratio at said after-burner is 1.3.

* * * * *

REEXAMINATION CERTIFICATE (903rd)

United States Patent [19]

Okiura et al.

[11] B1 4,403,941

[45] Certificate Issued Jul. 26, 1988

[54] COMBUSTION PROCESS FOR REDUCING NITROGEN OXIDES

[75] Inventors: Kunio Okiura; Iwao Akiyama; Hiroshi Terada; Yoshijiro Arikawa; Akira Baba; Shigeki Morita, all of Kure, Japan

[73] Assignee: Babcock-Hitachi, Ltd., Tokyo, Japan

Reexamination Request:
No. 90/001,423, Jan. 7, 1988

Reexamination Certificate for:

| | |
|---|---|
| Patent No.: | **4,403,941** |
| Issued: | **Sep. 13, 1983** |
| Appl. No.: | **175,823** |
| Filed: | **Aug. 5, 1980** |

[30] Foreign Application Priority Data

Aug. 6, 1979 [JP] Japan ..... 54-99487

[51] Int. Cl.[4] ..... F23N 1/02

[52] U.S. Cl. ..... 431/10; 431/12; 431/165; 431/174; 431/351; 110/347

[58] Field of Search ..... 431/2, 10, 12, 159, 431/165, 174, 177, 178, 179, 351; 110/347

[56] References Cited

U.S. PATENT DOCUMENTS

| | | | |
|---|---|---|---|
| 3,048,131 | 8/1962 | Hardgrove | 110/72 |
| 3,228,451 | 1/1966 | Fraser et al. | 158/117.5 |
| 3,421,824 | 1/1969 | Herbst | 431/10 |
| 3,675,629 | 7/1972 | Stevens | 122/235 R |
| 3,727,562 | 4/1973 | Bauer | 110/1 P |
| 3,826,077 | 7/1974 | Quigg et al. | 60/39.02 |
| 3,832,122 | 8/1974 | LaHaye et al. | 431/10 |
| 3,865,084 | 2/1975 | DePoister | 122/235 B |
| 3,877,440 | 4/1975 | Winkin | 122/235 B |
| 3,890,084 | 6/1975 | Voorheis et al. | 431/10 |
| 3,948,223 | 4/1976 | Benson | 122/240 A |
| 4,004,875 | 1/1977 | Zink et al. | 431/9 |
| 4,021,186 | 5/1977 | Tenner | 431/10 |
| 4,050,877 | 9/1977 | Craig et al. | 431/76 |
| 4,060,376 | 11/1977 | Peredi | 432/24 |
| 4,095,928 | 6/1978 | Jones et al. | 431/8 |
| 4,117,075 | 9/1978 | Sano | 423/235 |
| 4,144,017 | 3/1979 | Barsin et al. | 431/10 |
| 4,240,784 | 12/1980 | Dauvergne | 431/351 |
| 4,250,820 | 2/1981 | Lautenschlager | 110/347 |

FOREIGN PATENT DOCUMENTS

| | | | |
|---|---|---|---|
| 0007697 | 2/1980 | European Pat. Off. . | |
| 0070434 | 6/1977 | Japan | 431/10 |
| 0105328 | 8/1979 | Japan | 431/10 |
| 1460312 | 3/1974 | United Kingdom . | |

*Primary Examiner*—Margaret A. Focarino

[57] ABSTRACT

A combustion process for reducing nitrogen oxides in combustors is proposed wherein combustion takes place successively forming an incomplete combustion zone, a reducing combustion zone, and a complete combustion zone, respectively corresponding to primary burners, secondary burners and air ports or after-burners, successively arranged in the direction of gas stream in a furnace. According to the present invention, it is possible to reduce nitrogen oxides by improving a manner of combustion without providing any denitrating apparatuses for exhaust gas.

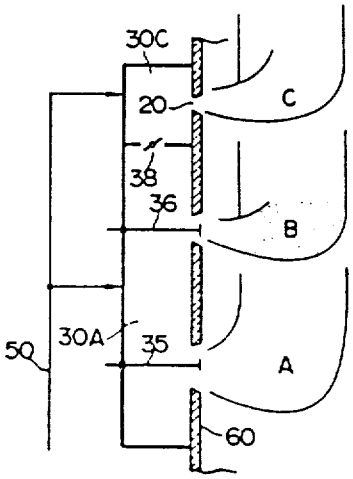

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–12 is confirmed.

* * * * *